United States Patent [19]

Tommaney et al.

[11] Patent Number: 4,529,442

[45] Date of Patent: Jul. 16, 1985

[54] METHOD FOR PRODUCING STEEL IN A TOP OXYGEN BLOWN VESSEL

[75] Inventors: Joseph W. Tommaney, Buffalo Township, Butler County; David R. Shidemantle, Butler, both of Pa.; Harry L. Bishop, Jr., Delmar, N.Y.

[73] Assignee: Allegheny Ludlum Steel Corporation, Pittsburgh, Pa.

[21] Appl. No.: 604,097

[22] Filed: Apr. 26, 1984

[51] Int. Cl.[3] ..... C21C 7/00

[52] U.S. Cl. ..... 75/59.12; 75/59.1

[58] Field of Search ..... 75/59, 60

[56] References Cited

U.S. PATENT DOCUMENTS

| | | | |
|---|---|---|---|
| 3,252,790 | 5/1966 | Krivsky | 75/59 |
| 3,325,278 | 6/1967 | McClellan | 75/60 |
| 3,854,932 | 12/1974 | Bishop, Jr. | 75/60 |
| 3,860,418 | 1/1975 | Josefsson et al. | 75/60 |
| 4,280,838 | 7/1981 | Marukawa et al. | 75/60 |
| 4,325,730 | 4/1982 | Schleimer et al. | 75/52 |
| 4,334,922 | 6/1982 | Metz et al. | 75/60 |
| 4,345,746 | 8/1982 | Schleimer et al. | 266/90 |
| 4,369,060 | 1/1983 | Metz et al. | 75/60 |
| 4,397,685 | 8/1983 | Maddever et al. | 75/60 |
| 4,462,825 | 7/1984 | Messina | 75/60 |

*Primary Examiner*—Peter D. Rosenberg

*Attorney, Agent, or Firm*—Patrick J. Viccaro

[57] ABSTRACT

A method for producing steel in a top-blown molten metal vessel having a hot metal charge to form a bath. The method comprises top blowing from a lance oxygen gas onto or beneath the surface of the bath while introducing an inert gas to the bath from beneath the surface thereof during said top blowing. The rate of inert gas is increased progressively during top blowing of oxygen and the rate of oxygen is decreased progressively during said top blowing.

16 Claims, No Drawings

METHOD FOR PRODUCING STEEL IN A TOP OXYGEN BLOWN VESSEL

BACKGROUND OF THE INVENTION

This invention relates to blowing processes for refining molten metal in a vessel. Particularly, the invention relates to top blowing processes for improving removal of carbon, such as in a basic oxygen process.

It is known to produce ferrous metals in molten metal vessels wherein top blowing with oxygen through a lance positioned above the bath is used. For this purpose the vessel is typically charged with 60 to 80% hot metal, for example, from a blast furnace and 20 to 40% of a cold charge which may be high-carbon chromium alloy and/or stainless steel scrap. Top oxygen blowing is performed until the final bath carbon level has been reduced to approximately 0.035 to 0.05%; at which time the bath temperature is typically 3400° to 3600° F. (1871° to 1982° C.). At such carbon content, which may be currently achieved by the use of a top-blown basic oxygen converter, the bath temperatures are sufficiently high that excessive refractory wear occurs. Presently, many product specifications require carbon levels less than 0.03%. The standard basic oxygen furnace practice cannot attain such low carbon levels.

It is also known, in top-blown oxygen steelmaking processes of this type, to blend an inert gas, such as argon, with the oxygen introduced by top blowing near the end of the blowing cycle. Although argon serves to improve the efficiency of the carbon removal, nevertheless, stainless steels having carbon contents less than about 0.03% may not be commercially produced on a consistent basis.

It has also been proposed to adapt a basic oxygen converter vessel for introduction of an inert gas to the bath from beneath the surface thereof by the use of tuyeres or porous plugs arranged on or near the bottom of the vessel. Concurrently filed, copending application Ser. No. 604,098, filed Apr. 26, 1984, discloses a method which comprises top blowing from a lance oxygen and/or a mixture or oxygen and inert gas onto or beneath the bath surface while introducing a low flow rate inert gas to the bath from beneath the surface during the top blowing. The overall ratio of oxygen-to-inert gas is decreased progressively during top blowing. The relative proportion of the top-blown gases and bottom inert gas remain substantially the same throughout the process.

There have been proposals by others to use top blowing of oxygen and bottom injection of inert gases. U.S. Pat. No. 3,325,278, issued June 13, 1967, discloses top blowing of oxygen onto the bath surface while concurrently introducing an inert gas in the lower portion of the bath at a rate no greater than the top oxygen flow rate. U.S. Pat. No. 3,854,932, issued Dec. 17, 1974, describes a method of top blowing oxygen while introducing an inert or endothermic gas through a bottom tuyere while maintaining a subatmospheric pressure in the converter. U.S. Pat. No. 4,280,838, issued July 28, 1981, discloses a method of top blowing oxygen and bottom blowing through tuyeres a gas predominantly carbon dioxide at a rate which is a small fraction of the rate of top-blown oxygen. Several other patents describe methods of top blowing oxygen and bottom blowing inert gas through tuyeres as a function of slag levels, such as U.S. Pat. Nos. 3,860,418; 4,325,730; 4,334,922; 4,345,746; and 4,369,060.

It is, accordingly, an object of the invention to provide a method for producing steel in a top-blown oxygen converter by simultaneously top blowing with oxygen and introducing inert gas from beneath the surface of the bath, wherein the rate of top-blown oxygen is progressively decreased as the rate of inert gas introduced beneath the bath surface is progressively increased.

This and other objects of the invention, as well as a more complete understanding thereof, may be obtained from the following description and specific examples.

SUMMARY OF THE INVENTION

In accordance with the present invention, a method is provided for producing steel in a top-blown vessel having a hot metal charge forming a bath. The method includes top blowing oxygen from a lance onto or beneath the bath surface and introducing an inert gas to the bath from beneath the surface during said top blowing, thereby establishing a ratio of oxygen-to-inert gas of more than 1/1. Thereafter, the top-blown oxygen rate is progressively decreased while increasing the introduction of inert gas so as to progressively decrease the ratio of oxygen-to-inert gas during top blowing as the carbon content of the bath is reduced. The top blowing is stopped when the desired carbon content is reached and when the ratio is less than 1/1.

DETAILED DESCRIPTION OF THE PREFERRED EMBODIMENTS

The method of the present invention relates to producing steel in a top-blown metal vessel. The charge could be prealloyed comprising substantially all molten metal, such as could be supplied from an electric furnace, having relatively low carbon levels. The charge may include cold charge materials, such as scrap, chromium and other materials, and have higher carbon levels. Typically, a top-blown molten metal vessel, such as a basic oxygen converter, would have a high carbon hot metal charge and a cold material charge to form a bath.

In the practice of the invention, a top-blown basic oxygen converter may be used having a conventional lance adapted for introducing gas onto or beneath the surface of the charge within the vessel and additionally having means, such as tuyeres and/or porous plugs, positioned on or near the bottom of the vessel for introduction of inert gas beneath the surface of the bath. The lance may be suspended above the bath or be a type capable of being submerged within the bath, both of which practices are conventional and well known in the art. Further, in accordance with the invention, at the outset of the blowing cycle, the gas introduced by top blowing through the lance is oxygen and establishes a high ratio relative to the inert gas introduced from beneath the surface of the bath. The total oxygen-to-inert gas ratio is decreased progressively during blowing and at the conclusion of blowing there is a relatively low ratio of oxygen-to-inert gas resulting from decreasing the top-blown oxygen rate and increasing the rate of the inert gas. It should be understood that the method of the invention may be only a part of a production process wherein no inert gas is introduced beneath the bath surface, such as through tuyeres and/or porous plugs, before or after using the method of the invention. It is also intended that the inert gas may be introduced beneath the surface intermittently during the top blowing.

In the manufacture of steel, for example, it may be necessary that the ratio of oxygen-to-inert gas be decreased as the blow progresses. The method of the present invention may be used in the manufacture of stainless steel, for example, in vessels that are suitable for the manufacture of a variety of steels. More specifically, for about 80-ton heats, the inert gas introduced from beneath the surface of the bath is progressively increased within the range of approximately 100 to 7500 NCFM (normal cubic feet per minute) and the oxygen rate is progressively decreased within the range of 6500 to 400 NCFM. On a tonnage basis, the flow rates convert to 1.25 to 93.75 NCFM/ton for inert gas and 81.25 to 5 NCFM/ton for oxygen, or approximately 1 to 100 NCFM/ton and 85 to 5 NCFM/ton, respectively.

The inert gas introduced into the molten bath serves primarily two purposes. First, the inert gas dilutes the CO formed during decarburization. When an inert gas, such as argon, is mixed with the carbon monoxide, the partial pressure of carbon monoxide is reduced and the carbon-plus-oxygen reaction is favored over metallic oxidation, such as the chromium-plus-oxygen reaction. As the carbon level in the bath is reduced, more inert gas is required to maintain this relationship. Second, the bottom inert gas flow produces agitation and stirring of the bath. Such stirring tends to promote mixing of the bath to facilitate homogeneity and to avoid stratification of metallics in the bath.

The high ratio of oxygen-to-inert gas could be about 20/1 or more at the outset and would progress to about 1/3 or lower at the end of the blowing cycle. More specifically in this regard, the oxygen-to-inert gas ratio would initially be about 20/1 until the carbon in the bath is reduced to about 2%, preferably 1%, at which time the ratio would then be about 3/1 until the carbon in the bath is reduced to about 0.5%, then the ratio would be about 1/1 until the carbon in the bath is reduced to about 0.08% and thereafter the ratio would be about 1/3 until blowing is ended and a desired carbon content is achieved. In some instances it is desirable to use 100% inert gas as the final stage of blowing, by stopping the top blowing of oxygen. The progressive changing of the ratio may be accomplished in a stepwise manner, such as at the above-mentioned values, or continuously and incrementally so as to achieve the desired ratio values at specified carbon levels. By the practice of the present invention, carbon contents less than about 0.03% may be achieved.

The inert gas, as used herein, is substantially nonreactive with the molten metal and could be argon, nitrogen, xenon, neon and the like, and mixtures thereof. It is understood that nitrogen, although identified as an inert gas herein, could react with any nitride-forming constituents remaining in the bath. The process may also include other suitable gases which could include endothermic gases, such as carbon dioxide. As used herein, "inert gas" includes endothermic gases. The inert gas used throughout the process of the present invention may be a single gas, or a mixture of gases, which can have the same or varied composition throughout the blowing cycle in order to achieve the desired final carbon level. For example, the inert gas may be argon in a portion of the blowing cycle and nitrogen in another.

As conventional lances are designed for specific flow rates and molten bath penetration, it appears that at least two lances of different design are necessary. Preferably, in the practice of the invention, a first or regular lance is initially used that is adapted for the relatively high oxygen flow rates within the range of 4000 to 7000 NCFM, for example, in 80-ton heats. On a tonnage basis, the range converts to 50 to 87.5 NCFM/ton, or approximately 50 to 100 NCFM/ton. During the latter portion of the blowing cycle wherein lower flow rates are required, a second or special lance adapted for these lower flow rates is substituted. Specifically, this second lance would be adapted for oxygen flow rates of less than about 4000 NCFM, and as low as about 100 NCFM. On a tonnage basis, the range converts to 1.25 to 50 NCFM/ton, or approximately 1 to 50 NCFM/ton. It is preferred, however, that a single lance having a broad range of flow rates be used over the range of 100 to 7000 NCFM, for example, to provide the desired oxygen-to-inert gas ratios. Furthermore, when flow rates through the tuyeres extend up to about 7500 NCFM, then the second top lance useful to obtain the lower top-blown gas flow rates may not be needed in order to achieve the desired oxygen-to-inert gas ratios.

By way of specific example, and for comparison with the practice of the invention, AISI Types 405DR, 409 and 413 stainless steels were produced using (1) a standard BOF practice wherein oxygen was top blown onto and beneath the surface of the bath; (2) mixed gas top blowing in a BOF wherein oxygen was blown from a lance onto and beneath the surface of the surface of the bath and argon gas was mixed with the oxygen from the lance near the end of the blowing cycle; and (3) AOD defining wherein a combination of oxygen and argon was introduced into the melt to lower carbon to the final desired level.

To determine the relative efficiencies of the various melt practices, a determination was made of the metallic oxidation factor. The key criteria for melting efficiency is the metallic oxidation factor which is defined as the percentage of bath composition, other than carbon and silicon, which is oxidized during blowing. The standard method of determining the metallic oxidation factor assumes that the end product of the carbon-oxygen reaction is 100% CO or that the $CO/CO_2$ ratio is known. The factor is then calculated by subtracting the amount of oxygen reacting with the known carbon and silicon from the total oxygen blown to determine the total oxygen used to oxidize metallics. Based on the product of the total charge, the percent of oxidized metallics is found. It is desirable that the metallic oxidation factor be kept as low as possible.

TABLE

| | Heat No. | Type | End Blow Temp. (°F.) | End Blow % C | After Reduction % C | Final* % C | Metallic Oxidation Factor |
|---|---|---|---|---|---|---|---|
| Standard BOF | 130102 | 409 | 3540 | — | .038 | .039 | 8.5 |
| | 130125 | 409 | 3575 | — | .036 | .042 | 8.4 |
| | 130149 | 409 | 3560 | — | .042 | .048 | 7.9 |
| | 130273 | 409 | 3570 | — | .040 | .040 | 8.3 |
| | Average | | 3561 | — | .039 | .042 | 8.3 |
| Mixed Gas Top Blown | 129151 | 405DR | 3390 | .028 | .031 | .035 | 7.6 |
| | 229680 | 405DR | 3350 | .025 | .035 | .033 | 8.0 |
| | 130100 | 405DR | 3370 | .010 | .024 | .024 | 8.1 |
| | 129978 | 405DR | 3320 | .028 | .049 | .049 | 8.0 |
| | Average | | 3358 | .023 | .035 | .035 | 7.9 |
| AOD | 871371 | 413 | — | — | .021 | .012 | 4.2 |
| | 871566 | 413 | — | — | .015 | — | 4.1 |
| | 871555 | 413 | — | — | .014 | .021 | 3.1 |
| | 871444 | 413 | — | — | .013 | .014 | 3.6 |
| | Average | | — | — | .016 | .016 | 3.8 |

TABLE-continued

| | Heat No. | Type | End Blow Temp. (°F.) | End Blow % C | After Reduction % C | Final* % C | Metallic Oxidation Factor |
|---|---|---|---|---|---|---|---|
| Top | 284640 | 409 | 3280 | .025 | .020 | .023 | 5.0 |
| Oxygen | 284641 | 409 | 3275 | .018 | .027 | .028 | 4.8 |
| Bottom | 284645 | 413 | 3260 | .010 | .015 | .018 | 4.3 |
| Inert | 284646 | 413 | 3195 | .015 | .023 | .025 | 3.5 |
| (Present | 284639 | 409 | 3220 | .024 | .021 | .025 | 4.9 |
| Invention) | 284642 | 413 | 3260 | .019 | .013 | .017 | 4.7 |
| | | Average | 3250 | .019 | .020 | .023 | 4.7 |

*Carbon aim in all cases was less than 0.03%

The standard BOF heats reported in the Table of AISI Type 409 stainless steel were produced from an 80-ton batch of approximately 70–80% hot metal and 20–30% high carbon chromium alloy and stainless steel scrap. Oxygen blowing was at a rate of about 6500 NCFM (normal cubic feet per minute) from a top lance located above the bath a distance within the range of 30 to 80 inches. Oxygen blowing was continued to the turndown or end blow temperature reported in the Table.

The mixed gas top-blown AISI Type 405 heats were similarly produced, except that argon was blended with oxygen near the end of the blow in accordance with the following schedule:

| Total $O_2$ (NCF) | $O_2$ FLow Rate (NCFM) | Ar Flow Rate (NCFM) |
|---|---|---|
| 0 to 135,000 | 6,500 | 0 |
| 135,000 to 145,000 | 4,800 | 2,400 |
| 145,000 to 160,000 | 3,500 | 3,500 |
| 160,000 to 170,000 | 2,400 | 4,800 |

The four AOD heats of AISI Type 413 stainless steels were conventionally produced by refining with a combination of oxygen and argon.

The combined top blowing with oxygen and bottom blowing with inert gas in accordance with the practice of the invention was performed to produce heats of AISI Types 409 and 413 stainless steel. Argon gas was introduced through three bottom tuyeres located in a triangular pattern near the bottom of the BOF vessel. Total bottom flow rates for argon during the blow ranged from 600 to 1200 NCFM. Oxygen was top blown at rates from 4000 to 6500 NCFM using a regular 3-hole BOF lance. This regular lance was replaced by a special low flow, single-hole lance to achieve oxygen-to-argon ratios of 1/1 and lower. Oxygen flow rates within the range of 400 to 1200 NCFM were obtained using the special lance. The blowing schedule for these heats was as follows:

| Lance Type | Ratio | $O_2$ Flow Rate (NCFM) | Ar Flow Rate (NCFM) | Total Flow Rate (NCFM) |
|---|---|---|---|---|
| Regular | 11/1 | 6,500 | 600 | 7,100 |
| Regular | 3/1 | 4,000 | 1,250 | 5,250 |
| Special | 1/1 | 1,000 | 1,000 | 2,000 |
| Special | 1/3 | 400 | 1,200 | 1,600 |

These heats were produced by charging 130,000 pounds of hot metal in the BOF vessel. The solid charge consisted of 35,000 pounds of 52% chromium, high carbon ferrochromium added to the vessel in two batches after between 20,000 to 60,000 cubic feet of oxygen had been blown. Approximately 1 minute after the start of blowing, 3,000 pounds of dolomite and 9,000 pounds of burnt lime were added to the vessel for each of the heats. A reduction mixture consisting of chromium silicide and lime, in a quantity sufficient to achieve a $CaO/SiO_2$ ratio of 2/1, was added after the end of blowing. The reduction mixture was stirred with 1,200 NCFM of argon from the tuyeres for approximately five minutes.

It can be seen from the blowing schedule that the combined total flow rate of the top-blown and bottom-introduced gases progressively decrease throughout the blowing cycle. The total flow rate at the end is less than 50%, and more specifically, about 25%, of the total flow rate at the beginning. It is desirable to keep the total flow rate substantially constant throughout the process; however, the total flow rate was limited by the maximum flow rate achievable through the bottom tuyeres. The example demonstrates though that even with the reduced flow rates, the present invention successfully lowered carbon to the desired levels.

With respect to achieving the desired carbon aim of 0.03% or less, it may be seen from the Table that both the AOD processed heats and the heats processed by combined top and bottom blowing in accordance with the invention easily achieved this carbon level; whereas, none of the conventionally-produced BOF heats met the 0.03% carbon maximum requirement. It may be observed that all of the top mixed gas blown heats were below the 0.03% carbon level at the end of the blow cycle, but only one of the heats was less than this value at final analysis. This indicates a stratification of carbon in the bath which results from lack of stirring action of the type achieved with the top oxygen and bottom inert blowing practice of the present invention.

Of the various melting practices reported, only the conventional BOF practice produced excessive temperatures from the standpoint of causing undue refractory wear and requiring the addition of cold scrap for cooling of the bath. The key criteria for melting efficiency is the metallic oxidization factor. An advantage of the present invention is that the desired carbon level was reached at lower temperatures and at lower metallic oxidization factor. The typical bath temperature at the end of the blow is below 3300° F., and preferably between 3100°–3300° F. (1704.5°–1815.5° C.).

As was an object, the present invention is a method for producing steel having carbon contents of less than 0.03% in a top-blown vessel. The method has the advantage of reducing oxidization of valuable metallics, such as chromium, while having end blow temperatures below 3300° F. Furthermore, the method is useful in retrofitting existing equipment using conventional top lances and bottom tuyeres and/or plugs.

Although preferred and alternative embodiments have been described, it will be apparent to those skilled in the art that changes can be made therein without departing from the scope of the invention.

What is claimed is:

1. A method for producing steel in a top-blown molten metal vessel having a hot metal charge to form a bath, the method comprising:

top blowing oxygen from a lance onto or beneath the surface of the bath;

introducing inert gas to the bath from beneath the surface of the bath during said top blowing;

thereby establishing a ratio of oxygen-to-inert gas of more than 1/1;

progressively decreasing the top-blown oxygen while increasing the introduction of inert gas so as to progressively decrease the ratio of oxygen-to-inert gas during said top blowing as the carbon content of the bath is reduced; and stopping said top blowing when the desired carbon content is reached and with said ratio being less than 1/1.

2. The method of claim 1 wherein during said top blowing, the inert gas introduced beneath the surface of the bath is increased within the range of 1 to 100 cubic feet per minute per ton.

3. The method of claim 1 wherein during said top blowing, the oxygen is decreased within the range of 85 to 5 cubic feet per minute per ton.

4. The method of claim 1 wherein during said top blowing, the inert gas introduced beneath the surface of the bath is increased within the range of 1 to 100 cubic feet per minute per ton, and the top-blown oxygen is decreased within the range of 85 to 5 cubic feet per minute per ton.

5. The method of claim 1 wherein the ratio of oxygen-to-inert gas is decreased from about 20/1 or more to 1/3 or lower progressively during said top blowing.

6. The method of claim 5 wherein during said top blowing, the ratio of oxygen-to-inert gas is maintained at a high ratio of about 11/1 until carbon in the bath is reduced to about 1%, at a ratio of about 3/1 until carbon in said bath is reduced to about 0.5%, about 1/1 until the carbon in said bath is reduced to about 0.08% and about 1/3 until blowing is ended and a desired carbon content is achieved.

7. The method of claim 6 wherein the desired carbon content is less than about 0.03%.

8. The method of claim 1 wherein the inert gas introduced to said bath is an inert gas selected from the group consisting of argon, nitrogen, xenon, neon and the like, carbon dioxide and mixtures thereof.

9. The method of claim 1 wherein the combined total flow rate of top-blown and bottom-introduced gases is progressively decreased throughout the blowing cycle so that the total flow rate at the end is less than 50% of the total flow rate at the beginning.

10. The method of claim 1 wherein the bath temperature at the end of the blow is less than 3300° F.

11. The method of claim 1 wherein the bath contains a high carbon hot metal charge and a cold material charge.

12. The method of claim 1 wherein the inert gas is introduced beneath the bath surface before commencing the top blowing.

13. The method of claim 1 wherein the final stage of blowing includes blowing only inert gas.

14. In a method for producing steel in a top-blown molten metal vessel having a charge of high carbon hot metal to form a bath, which method decarburizes the molten bath to a desired carbon content by top blowing oxygen from a lance onto or beneath the surface of the bath and introducing an inert gas to the bath from beneath the surface of the bath, wherein the improvement comprises:

top blowing oxygen to establish a ratio of oxygen-to-inert gas of more than 1/1;

progressively decreasing the top-blown oxygen while increasing the introduction of inert gas so as to progressively decrease the ratio of oxygen-to-inert gas during said top blowing as the carbon content of the bath is reduced; and stopping said top blowing with the ratio being less than 1/1.

15. The method of claim 1 wherein the total flow rate of top-blown and bottom-introduced gases is substantially constant.

16. A method for producing steel in a top-blown molten metal vessel having a hot metal charge to form a bath, the method comprising:

top blowing oxygen from a lance onto or beneath the surface of the bath;

introducing inert gas to the bath from beneath the surface of the bath during said top blowing;

thereby establishing a ratio of oxygen-to-inert gas of more than 1/1;

progressively decreasing the top-blown oxygen while increasing the introduction of inert gas so as to maintain a substantially constant total flow rate of top-blown and bottom-introduced gases and to progressively decrease the ratio of oxygen-to-inert gas during the top blowing as the carbon content of the bath is reduced; and stopping said top blowing when the desired carbon content of less than about 0.03% is reached and with said ratio being less than 1/1 and a bath temperature of about 3300° F. or less.

* * * * *